US010782627B1

(12) United States Patent
Dale et al.

(10) Patent No.: US 10,782,627 B1
(45) Date of Patent: Sep. 22, 2020

(54) REDUCING WASTE TONER WITH ELECTROPHOTOGRAPHIC VOLTAGE CONTROL IN IMAGING DEVICES

(71) Applicant: LEXMARK INTERNATIONAL, INC., Lexington, KY (US)

(72) Inventors: Andrew Pryse Dale, Lexington, KY (US); Matthew David Heid, Louisville, KY (US); Christopher David Strack, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/443,985

(22) Filed: Jun. 18, 2019

(51) Int. Cl.

| | |
|---|---|
| ***G03G 15/02*** | (2006.01) |
| ***G03G 15/08*** | (2006.01) |
| ***G03G 15/00*** | (2006.01) |
| ***G03G 15/06*** | (2006.01) |

(52) U.S. Cl.
CPC ..... *G03G 15/0283* (2013.01); *G03G 15/065* (2013.01); *G03G 15/0812* (2013.01); *G03G 15/5004* (2013.01); *G03G 15/80* (2013.01)

(58) Field of Classification Search
CPC ..... G03G 15/065; G03G 15/0266; G03G 15/0283; G03G 15/5004; G03G 21/20; G03G 21/203
See application file for complete search history.

(56) References Cited

U.S. PATENT DOCUMENTS

| | | | | |
|---|---|---|---|---|
| 5,426,488 | A | 6/1995 | Hayakawa | |
| 5,799,225 | A | 8/1998 | Abe | |
| 6,327,445 | B1 | 12/2001 | Honda | |
| 6,336,007 | B1 | 1/2002 | Sugisaki | |
| 2003/0175040 | A1 | 9/2003 | Ogata | |
| 2004/0042813 | A1* | 3/2004 | Takai | G03G 15/5004 399/88 |
| 2007/0019971 | A1* | 1/2007 | Dan | G03G 15/6564 399/16 |
| 2010/0080587 | A1 | 4/2010 | Booth | |
| 2013/0136468 | A1 | 5/2013 | Shimizu | |
| 2013/0177328 | A1 | 7/2013 | Fukuda | |
| 2014/0056604 | A1 | 2/2014 | Hayakawa | |
| 2014/0356005 | A1 | 4/2014 | Sakamoto | |
| 2017/0308008 | A1 | 10/2017 | Aiba | |
| 2018/0113397 | A1* | 4/2018 | Ozeki | G03G 15/0806 |
| 2018/0253051 | A1 | 9/2018 | Nakai | |

* cited by examiner

*Primary Examiner* — Thomas S Giampaolo, II

(57) ABSTRACT

An imaging device includes a photoconductive drum charged by a charge roll and opposed by developer roll. The developer roll adds toner to the drum to develop a latent image on the drum for transfer to media. One or more high voltage power supplies communicate with a controller to set voltages on the rolls. The controller determines whether imaging of the media is to occur at a time when the drum is rotating. If not, a laser beam discharges the drum and the voltage on the charge roll is decreased to reduce the charge on the drum, but the controller maintains the voltage differential between the drum and the developer roll.

19 Claims, 1 Drawing Sheet

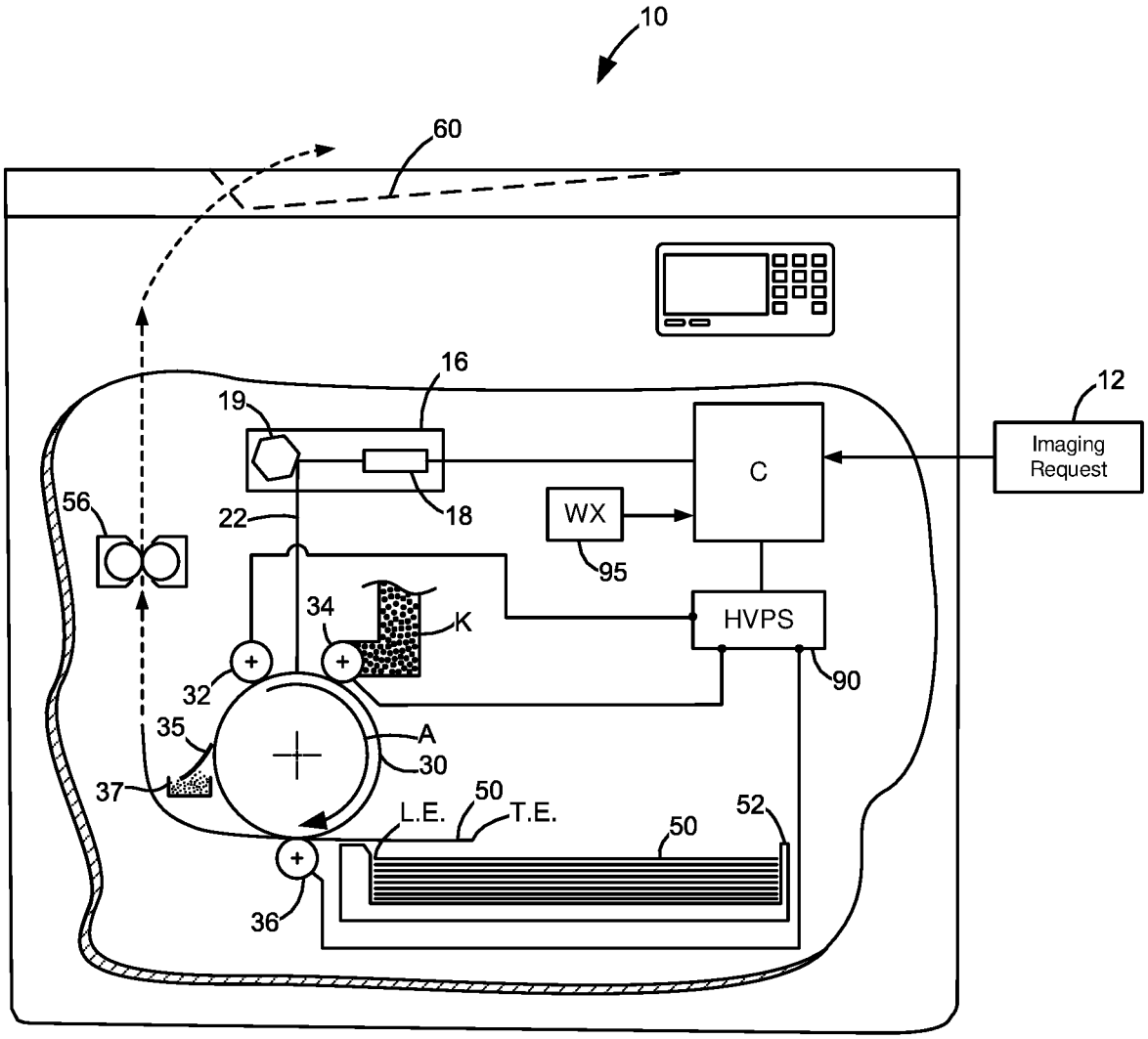
10
60
16
19
12
Imaging Request
C
18
WX
95
56
22
34
K
HVPS
90
32
35
A
30
37
L.E.
50
T.E.
52
50
36

REDUCING WASTE TONER WITH ELECTROPHOTOGRAPHIC VOLTAGE CONTROL IN IMAGING DEVICES

The present disclosure relates to the electrophotographic (EP) process in imaging devices, such as printers, copiers, all-in-ones, multi-function devices, etc. It relates further to controlling voltages of the EP process to reduce waste toner.

BACKGROUND

The EP process includes a laser discharging a charged PC drum to create a latent image that becomes toned with one or more toners (e.g., black, cyan, magenta, yellow). A voltage difference between the drum and an opposed transfer roll transfers the image to a media sheet or to an intermediate transfer member (ITM) for subsequent transfer to a media sheet. A corona or charge roll sets the charge on the PC drum and a developer roll introduces the toner to the latent image. A controller coordinates with one or more high voltage power supplies to provide power to the laser and to set relevant charges on the rolls.

However, hot temperature and high humidity operating environments typically cause the generation of more waste toner compared to cooler temperatures and dryer conditions. More waste fills up waste reservoirs faster which can lead to fewer pages available for imaging and less reliable toner cartridges, such as occurs with toner leakage. Attempts to control this include mechanically separating the developer roll and toner from the drum so that, while the drum rotates, toner cannot attract to the drum, but such increases design complexity and adds hardware cost. Still other attempts seek to shorten the rotations of the drum during non-imaging events, such as before and after imaging jobs. Still others have utilized AC power solutions, but such does not work with DC power supplies. The inventors have identified a need in the art to economically and simply overcome these and other problems.

SUMMARY

The embodiments described herein relate to methods and apparatus that minimize the accumulation of waste toner under relatively hot and humid conditions in which the imaging device operates. In one design, the imaging device includes a photoconductive drum charged by a charge roll and opposed by developer roll. The developer roll adds toner to the drum to develop a latent image on the drum for transfer to media. One or more power supplies communicate with a controller to set voltages on the rolls. Under relatively hot and humid operating conditions, waste toner accumulates quickly so the controller determines whether imaging of the media is to occur at a time when the drum is rotating. If no imaging, but a rotating drum, a laser beam discharges the drum and the voltage on the charge roll is decreased to reduce the charge on the drum, but the controller maintains the voltage differential between the drum and the developer roll. The amount of adjustment in voltages varies based on the temperature and humidity. The technique applies to both color and monochromatic imaging devices having direct or indirect transfer to media.

DRAWINGS

The sole FIGURE is a diagrammatic view of an imaging device for reducing waste toner with EP voltage control.

DETAILED DESCRIPTION OF THE EMBODIMENTS

FIG. 1 teaches an imaging device 10 for reducing waste toner. The device is black only (shown) or color-imaging capable (not shown). The device receives at a controller, C, an imaging request 12 for imaging media 50. The controller typifies an ASIC(s), circuit(s), microprocessor(s), firmware, software, or the like. The request comes from external to the imaging device, such as from a computer, laptop, smart phone, cloud service, fax machine, etc. It can also come internally, such as from a copying request. In any, the controller converts the request to appropriate signals for providing to a laser scan unit 16. The unit turns on and off a laser 18 according to pixels of the imaging request. A rotating mirror 19 and associated lenses, reflectors, etc. (not shown) focus a laser beam 22 onto a photoconductive drum 30 rotating in the direction of arrow (A), as is familiar, or plural drums for color imaging (not shown). The drums correspond to supplies of toner, such as yellow (y), cyan (c), magenta (m) or black (k). A charge roll 32 sets a charge on a surface of the drum 30 as the drum rotates. The laser beam 22 electrostatically discharges the drums to create a latent image. A developer roll 34 introduces toner to the latent image and such is electrostatically attracted to create a toned image on a surface of the drum. A voltage differential between the surface of the drum 30 and an opposed transfer roll 36 transfers the toned image direct from the drum to a sheet of media 50 or indirect to an intermediate transfer member (not shown) for subsequent transfer to the media. The sheet advances from a tray 52 to a fuser assembly 56 to fix the toned image to the media through application of heat and pressure. Users pick up the media from a bin 60 after it advances out of the imaging device. The controller coordinates the operational conditions that facilitate the timing of the image transfer and transportation of the media from tray to output bin. The controller also coordinates with one or more high voltage power supplies 90 to set the relative voltages for the electrophotgraphic image process, including setting the voltages for the charge roll 32, the developer roll 34 and transfer roll 36.

To minimize the accumulation of waste toner from the drum scraped by a blade 35 into a reservoir 37, the controller implements an algorithmic routine of EP voltage control. The routine is triggered for execution at various times, but especially when the drum is rotating but the media is otherwise not undergoing imaging. In terms from the industry, the routine executes during "run-in" and "run-out" of an imaging request and/or at times when there exists an excessively large interpage gap. That is, "run-in" occurs when the controller begins preparing to honor the imaging request, but before the first page of the media of the imaging request becomes imaged with toner. Events undertaken by the controller at this time include signaling to motors to rotate the drums and rolls, to warm-up the fuser to fusing temperature, and to power the laser, to name a few. "Run-out," on the other hand, occurs after the last page of media of the imaging request has been imaged, but not yet exited the imaging device. The drum and rolls continue to rotate during this time. Excessively large interpage gaps exist during image duplexing of media sheets or when users operate the imaging device in narrow-media modes, such as when imaging envelopes. A size of the gaps are also measurable by the controller between a trailing edge (T.E) of one sheet of media 50 and a leading edge (L.E.) of an adjacent sheet of media. Operational conditions may be also considered when initiating the routine, such as accepting input from a local or remote weather station 95 regarding the relative humidity and temperature of the environment in which the imaging device is operating.

Regardless, once triggered, the routine consists of lowering the charge on the drum, but maintaining the voltage differential between the drum 30 and the developer roll 34. Under normal imaging conditions, the charge roll is set to about −1200 Vdc to charge the drum to about −700 Vdc. The developer roll, on the other hand, has its voltage set to about −600 Vdc. The voltage differential between the drum and developer roll is about 100 Vdc in magnitude, or −700 Vdc minus −600 Vdc=−100 Vdc, or |100| Vdc. Under the routine when the drum rotates but no imaging occurs, the controller erases the existing charge on the drum by discharging the laser. The laser beam writes all pixels to the drum. The controller next lowers the voltage on the charge roll, such as by turning off its voltage or setting a voltage close to 0 Vdc, so that the drum only charges to its core voltage of about −350 Vdc, vice −700 Vdc during imaging. The controller also keeps the voltage differential of 100 Vdc between the drum and the developer roll thereby setting the voltage of the developer roll to about −250 Vdc, or −350 Vdc minus −250 Vdc=−100 Vdc, or |100| Vdc. As a result, the inventors have discovered that much less toner becomes attracted to the drum and less waste toner results. Through empirical testing, the inventors have discovered that in environments of 78° F. and 80% humidity, for example, up to 66% of (k) waste toner has been eliminated in comparison to not executing the routine. The elimination of waste toner for (c), (y), and (m) also saw improvement in a range of 40%-50%. In comparison of the routine to simply lowering the voltage of the charge roll, to lower the charge on the drum, but not maintaining the voltage differential between the drum and developer roll, the inventors have recognized that appreciably more waste toner accumulates than when maintaining the voltage differential.

Of course, the voltages and differential given above are only representative. Other values are possible. Skilled artisans will appreciate that implementation details need understanding of how quickly power supplies can react to adjustment of their voltages and the speeds at which the drum and rolls rotate. In other embodiments, it is contemplated that a range of hot temperature and humidity conditions may be implemented in which to execute the routine, but at no other time. Alternatively, still, an amount of adjustment on the drum, but maintaining its voltage differential with the developer roll, can also exist based on specific values of the temperature and humidity of the operating environment. That is, the charge on the drum can be lowered to −300 Vdc when relatively cooler (e.g., 78° F.) and dryer (e.g., 80%), but lowering the charge on the drum to −350 Vdc when relatively hotter (e.g., 90° F.) and wetter (85%). Still other designs are readily imagined. In any, artisans should appreciate that the foregoing greatly overcomes designs of the prior art that involved mechanical separation between the developer units and drum and/or the use of AC power. Now the accumulation of waste toner can be minimized by a simple control routine that sets EP voltages.

The foregoing description of several methods and example embodiments has been presented for purposes of illustration. It is not intended to be exhaustive or to limit the claims. Modifications and variations to the description are possible in accordance with the foregoing. It is intended that the scope of the invention be defined by the claims appended hereto.

The invention claimed is:

1. In an imaging device having a photoconductive drum charged by a charge roll and opposed by developer roll to add toner to the drum to develop a latent image on the drum for transfer to media, further including a high voltage power supply in communication with a controller to set voltages on the charge roll and developer roll, a method comprising:

determining whether imaging of the media is to occur at a time when the drum is rotating; and if no imaging of the media, but rotation of the drum, turning off a voltage of the charge roll to reduce the charge on the drum and after the charge roll reaches 0 Vdc keeping a voltage differential between the drum and the developer roll at a constant voltage, wherein the constant voltage is a same voltage maintained between the drum and the developer roll when the media is being imaged under imaging conditions.

2. The method of claim 1, wherein the voltage differential is about |100| Vdc.

3. The method of claim 1, further including determining a size of an interpage gap of an imaging request.

4. The method of claim 1, further including determining whether or not a first page of an imaging request has been imaged.

5. The method of claim 1, further including determining whether or not a last page of an imaging request has been imaged.

6. The method of claim 1, further including erasing an existing charge on the drum.

7. The method of claim 6, further including discharging the drum with a laser beam.

8. The method of claim 1, further including determining a relative humidity of an operating environment of the imaging device.

9. The method of claim 1, further including determining a temperature of an operating environment of the imaging device.

10. The method of claim 1, further including determining a relative humidity and temperature of an operating environment of the imaging device and adjusting voltages based on results of the determining the relative humidity and temperature.

11. The method of claim 1, further including determining a relative humidity and temperature of an operating environment of the imaging device at a time before a first page of an imaging request.

12. The method of claim 1, further including decreasing a voltage on the developer roll.

13. The method of claim 1, wherein the voltage differential is about |100| Vdc and a voltage on the developer roll is about −250 Vdc while a voltage on the drum is about −350 Vdc.

14. The method of claim 1, further including maintaining a voltage on the developer roll of about −600 Vdc while a voltage on the drum is about −700 Vdc during the determining whether the imaging of the media is to occur at the time when the drum is rotating.

15. In an imaging device having a photoconductive drum charged by a charge roll and opposed by developer roll to add toner to the drum to develop a latent image on the drum for transfer to media, further including a high voltage power supply in communication with a controller to set voltages on the charge roll and developer roll, a method comprising:

determining a relative humidity and temperature of an operating environment of the imaging device;

determining whether imaging of the media is to occur at a time when the drum is rotating;

if no imaging of the media, but rotation of the drum, discharging the drum with a laser beam and turning off a voltage on the charge roll to reduce the charge on the drum, and after the charge roll reaches 0 Vdc keeping a constant voltage differential of 100 Vdc magnitude between the drum and the developer roll, wherein the constant voltage differential is a same voltage differential maintained between the drum and the developer roll when the media is being imaged under imaging conditions; and adjusting an amount of voltages based on results of the determining the relative humidity and temperature.

16. The method of claim 15, further including decreasing a voltage on the developer roll.

17. The method of claim 15, further including determining a size of an interpage gap existing between a trailing edge and a leading edge of adjacent sheets of media being imaged.

18. The method of claim 15, further including determining whether a first page of an imaging request has been imaged.

19. The method of claim 15, further including determining whether a last page of an imaging request has been imaged.

* * * * *